US006568234B2

(12) United States Patent
Shore

(10) Patent No.: US 6,568,234 B2
(45) Date of Patent: May 27, 2003

(54) ROLLING MILL FINISHING SECTION

(75) Inventor: T. Michael Shore, Princeton, MA (US)

(73) Assignee: Morgan Construction Company, Worcester, MA (US)

( * ) Notice: Subject to any disclaimer, the term of this patent is extended or adjusted under 35 U.S.C. 154(b) by 4 days.

(21) Appl. No.: 09/931,618

(22) Filed: Aug. 17, 2001

(65) Prior Publication Data

US 2002/0152786 A1 Oct. 24, 2002

Related U.S. Application Data

(60) Provisional application No. 60/264,218, filed on Jan. 25, 2001.

(51) Int. Cl.[7] ..... B21B 41/04
(52) U.S. Cl. ..... 72/228; 72/226
(58) Field of Search ..... 72/233, 234, 226, 72/228

(56) References Cited

U.S. PATENT DOCUMENTS 1,932,750 A * 10/1933 Rendleman ..... 72/228
3,228,505 A * 1/1966 Shore et al. ..... 72/228
3,383,896 A * 5/1968 Blinn ..... 72/226
5,050,418 A * 9/1991 Grotepass ..... 72/201
5,307,663 A * 5/1994 Shore et al. ..... 72/228
5,595,083 A * 1/1997 Shore ..... 72/249
5,823,036 A * 10/1998 Matsunaga ..... 72/181
5,893,288 A * 4/1999 Shore ..... 72/228
5,950,477 A * 9/1999 Matsunaga ..... 72/239
6,053,022 A * 4/2000 Shore ..... 72/249
6,161,411 A * 12/2000 Bocking ..... 72/228
6,332,255 B1 * 12/2001 Buchsbaum et al. ..... 29/33 C

* cited by examiner

*Primary Examiner*—Allen Ostrager
*Assistant Examiner*—John S. Goetz
(74) *Attorney, Agent, or Firm*—Samuels, Gauthier & Stevens, LLP

(57) ABSTRACT

In a single strand hot rolling mill finishing section a plurality of multi-stand prefinishing rolling units are arranged along and are selectively shiftable onto and off of a first pass line segment. A multi-stand finishing rolling unit and a multi-stand post finishing rolling unit are arranged sequentially along a second pass line segment. A switch and associated delivery guides are selectively operable to direct products from the first pass line segment to the second pass line segment either at a location upstream of said finishing rolling unit, or alternatively, at a location between the finishing rolling unit and the post finishing rolling unit. With this arrangement, final rolling in the post finishing rolling unit may be preceded with or without rolling in the finishing rolling unit and with or without rolling in one or more of the prefinishing rolling units.

3 Claims, 1 Drawing Sheet

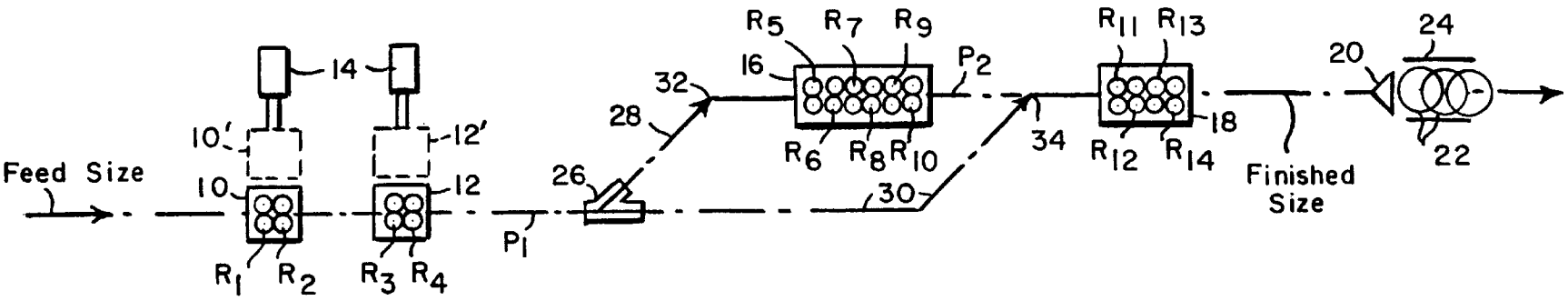
Feed Size
10'
10
R1
R2
14
12'
12
R3
R4
P1
26
28
32
16
R5
R6
R7
R8
R9
R10
P2
30
34
R11
R12
R13
R14
18
Finished Size
20
24
22

ROLLING MILL FINISHING SECTION

CROSS REFERENCE TO RELATED APPLICATION

This application claims priority from Provisional Patent Application Ser. No. 60/264,218 filed Jan. 25, 2001

BACKGROUND OF THE INVENTION

1. Field of the Invention

This invention relates to continuous single strand hot rolling mills of the type producing bar and rod products, and is concerned in particular with an improved layout of the rolling equipment in the finishing section of the mill.

2. Description of the Prior Art

In a typical continuous hot rolling mill of the type producing bar and rod products, billets are heated in a furnace and are then rolled in roughing and intermediate sections of the mill before being directed to the mill finishing section. The finishing section does what its name suggests, namely, to finish roll products in various sizes and to prescribed tolerances.

Typical mill finishing sections include one or more multi-stand rolling units with associated water boxes, shears, pinch rolls, etc. Conventional arrangements of such equipment impose undue restrictions on the range of finished products that can be efficiently produced from a selected size of feed stock supplied by the intermediate mill section.

The finishing mill layout of the present invention is largely free of the such restrictions, thus providing the mill operator with the ability to efficiently roll a wide range of finished products from a selected feed stock size.

SUMMARY OF THE INVENTION

In accordance with the present invention, multi-stand rolling units are aligned on different pass line segments. At least some of the rolling units are shiftable onto and off of their respective pass line segments, and switch mechanisms are operable in concert with the selective positioning of the shiftable rolling units to accommodate the rolling of a broad range of finished product sizes from a single feed stock.

These and other features and objectives of the present invention will now be described in further detail with reference to the accompanying drawings, wherein:

BRIEF DESCRIPTION OF THE DRAWING

The drawing is a schematic layout of a rolling mill finishing section in accordance with an exemplary and preferred embodiment of the invention.

DETAILED DESCRIPTION OF ILLUSTRATED EMBODIMENT

The drawing schematically depicts an exemplary layout of the invention including two multi-stand pre-finishing rolling units 10, 12 arranged sequentially on a first pass line segment $P_1$. The rolling units 10, 12 are each provided, respectively, with work roll pairs $R_1$, $R_2$ and $R_3$, $R_4$ whose roll axes are offset by 90° in a known manner to effect twist-free rolling in an oval/round pass sequence. Transfer mechanisms 14 are operable selectively to shift each rolling unit between its rolling position on the pass line segment $P_1$, as shown by the solid lines, and an inoperative position off the pass line segment $P_1$ as indicated by the broken lines at 10' and 12'. When inoperatively positioned off line, the rolling units may be refitted with replacement rolls and guides, and otherwise serviced and/or repaired.

A multi-stand finishing rolling unit 16 and a multi-stand post finishing rolling unit 18 are arranged sequentially on a second pass line segment $P_2$ leading to a laying head 20 which forms the end product into rings 22 deposited on a cooling conveyor 24. In the illustrated embodiment, the rolling unit 16 includes eight successive roll pairs $R_5$–$R_{10}$ configured to effect twist-free rolling in an oval/round pass sequence, and the rolling unit 18 has four successive roll pairs $R_{11}$–$R_{14}$ also arranged to effect twist-free rolling in an oval/round/round/round pass sequence.

The successive roll pairs $R_5$–$R_{10}$ may be selectively removed from the pass line segment $P_1$, a procedure commonly referred to as "dummying", making it possible to produce different size products out of the rolling unit 16.

The rolling unit may be of a well known type as described for example in U.S. Pat. No. 5,577,405 (Shore et al.), and the rolling unit may be of the type described in U.S. Pat. No. 5,325,697 (Shore et al.). The disclosures of both of these patents are herein incorporated by reference.

A switch mechanism 26 is selectively operable in conjunction with associated delivery pipes 28, 30 to direct products from the first pass line segment $P_1$ to the second pass line segment $P_2$ either at location 32 upstream of the rolling unit 16, or alternatively at location 34 between the rolling units 16, 18 and the post finishing block 18.

By selectively operating the transfer mechanisms 14 and the switch mechanism 26, the rolling units 10, 12, 16 and 18 can be utilized in various combinations, examples of which are denominated 1–4 in Table I.

TABLE I

| | ROLLING UNITS | | | |
|---|---|---|---|---|
| | 10 | 12 | 16 | 18 |
| 1. | O | O | O | X |
| 2. | X | O | O | X |
| 3. | X | X | O | X |
| 4. | X | X | X | X |

X = on line and operative
O = dummied or shifted off line

As shown below in Table II, this makes possible the production of multiple finished sizes from a single feed size, e.g., a round process section having a diameter of 21 mm.

TABLE II

| FEED SIZE (mm) | SIZE DELIVERED TO UNIT 18 | ROLLING UNITS 10 $R_1$ | $R_2$ | 12 $R_3$ | $R_4$ | 16 $R_5$ | $R_6$ | $R_7$ | $R_8$ | $R_9$ | $R_{10}$ | 18 $R_{11}$ | $R_{12}$ | $R_{13}$ | $R_{14}$ | FINISHED SIZES (mm) |
|---|---|---|---|---|---|---|---|---|---|---|---|---|---|---|---|---|
| 21.0 | 21.0 | O | O | O | O | O | O | O | O | O | O | X | X | X | X | 14.5/17.5 |
| 21.0 | 16.9 | X | X | O | O | O | O | O | O | O | O | X | X | X | X | 12/14 |

TABLE II-continued

| FEED SIZE (mm) | SIZE DELIVERED TO UNIT 18 | ROLLING UNITS 10 $R_1$ | $R_2$ | 12 $R_3$ | $R_4$ | 16 $R_5$ | $R_6$ | $R_7$ | $R_8$ | $R_9$ | $R_{10}$ | 18 $R_{11}$ | $R_{12}$ | $R_{13}$ | $R_{14}$ | FINISHED SIZES (mm) |
|---|---|---|---|---|---|---|---|---|---|---|---|---|---|---|---|---|
| 21.0 | 14.0 | X | X | X | X | O | O | O | O | O | O | X | X | X | X | 10/11.5 |
| 21.0 | 11.0 | X | X | X | X | X | X | O | O | O | O | X | X | X | X | 8/9.5 |
| 21.0 | 9.0 | X | X | X | X | X | X | X | X | O | O | X | X | X | X | 6.5/7.5 |
| 21.0 | 7.0 | X | X | X | X | X | X | X | X | X | X | X | X | X | X | 5.5/6.0 |

X = on line
O = dummied or shifted off line

The above tabulation is merely exemplary of the sizes that can be produced with a layout in accordance with the present invention.

In light of the foregoing, it will now be understood by those skilled in the art that various changes and modifications may be made to the disclosed embodiment while still remaining within the scope of the invention as defined by the appended claims. For example, instead of comprising "blocks", a term commonly understood to mean a plurality of roll stands mechanically interconnected and driven by a common drive, the rolling units 10, 12, 16, 18 may comprise groupings of separately driven roll stands. Although not shown, water boxes, pinch rolls, loopers etc. will normally be arranged along the pass line segments to accommodate rolling at different temperatures, depending on the metallurgical content of the product and its intended end use.

I claim:

1. A single strand hot rolling mill finishing section comprising:

a plurality of multi-stand prefinishing rolling units arranged along a first pass line segment;

transfer means for selectively shifting said prefinishing rolling units into and out of operative positions on said first pass line segment;

a multi-stand finishing rolling unit and a multi-stand post finishing rolling unit arranged sequentially along a second pass line segment, said second pass line segment being offset with respect to said first pass line segment; and switch means and associated delivery guides for directing products from said first pass line segment to said second pass line segment either at a location upstream of said finishing rolling unit, or alternatively at a location between said finishing rolling unit and said post finishing rolling unit, said transfer means and said switch means and associated delivery guides being selectively operable to precede final rolling in said post finishing rolling unit with or without rolling in said finishing rolling unit and with or without rolling in one or more of said prefinishing rolling units.

2. The rolling mill finishing section of claim 1 wherein a pair of said prefinishing rolling units are arranged along said first pass line segment.

3. A single strand hot rolling mill finishing section comprising:

multi-stand prefinishing rolling units (10, 12) arranged along a first pass line segment ($P_1$);

transfer means for selectively shifting said prefinishing rolling units onto and off of said first pass line segment;

a multi-stand finishing rolling unit (16) and a multi-stand post finishing unit (18) arranged sequentially along a second pass line segment ($P_2$), said second pass line segment being offset with respect to said first pass line segment; and switch means operable in concert with said transfer means to accommodate rolling of products in any one of at least the following rolling unit sequences:

18

10, 18

10, 12, 18

10, 12, 16, 18.

* * * * *